US005100242A

United States Patent [19]

Latto

[11] Patent Number: 5,100,242

[45] Date of Patent: Mar. 31, 1992

[54] VORTEX RING MIXERS

[76] Inventor: Brian Latto, R. R. #2, 153 Valley Rd., Dundas, Ontario, Canada, L9H 5E2

[21] Appl. No.: 537,678

[22] Filed: Jun. 14, 1990

Related U.S. Application Data

[63] Continuation-in-part of Ser. No. 369,802, Jun. 22, 1989, which is a continuation-in-part of Ser. No. 169,966, Mar. 18, 1988, abandoned, which is a continuation-in-part of Ser. No. 28,508, Mar. 20, 1987, abandoned.

[51] Int. Cl.[5] ..... B01F 5/12

[52] U.S. Cl. ..... 366/267; 366/118; 366/255

[58] Field of Search ..... 366/267, 262, 268, 269, 366/127, 108, 116, 117, 118, 600, 255, 256, 241, 348, 349, 101, 106

[56] References Cited

U.S. PATENT DOCUMENTS

| | | | |
|---|---|---|---|
| 126,735 | 5/1972 | Moxley | 366/268 |
| 207,085 | 8/1878 | Tise | 366/269 |
| 694,210 | 2/1902 | Sollner | 366/269 |
| 1,645,749 | 10/1927 | Gilbertson | 366/269 |
| 2,203,479 | 6/1940 | Witwer | 366/275 |
| 2,530,028 | 11/1950 | Petersen | 366/267 |
| 2,615,692 | 10/1952 | Muller | 366/332 |
| 3,399,869 | 9/1968 | Loria | 366/116 |
| 3,712,591 | 1/1973 | Booth | 366/275 |
| 4,229,302 | 10/1980 | Molvar | 210/220 |
| 4,534,914 | 8/1985 | Takahashi | 210/221.2 |
| 4,832,500 | 5/1989 | Brunold | 366/268 |

FOREIGN PATENT DOCUMENTS

| | | | |
|---|---|---|---|
| 153079 | 10/1920 | United Kingdom | 366/256 |

*Primary Examiner*—Robert W. Jenkins
*Attorney, Agent, or Firm*—Moss, Barrigar & Oyen

[57] ABSTRACT

A method of mixing fluids and mixing equipment is disclosed wherein an orifice plate is caused to be reciprocated at right angles to the plane of the orifice plate in a fluid to generate a ring vortex through the orifice, the orifice in the plate and the stroke of the plate are defined by the relationship $0.8 \leqq L/d \leqq 3.8$, where L is the stroke of the plate and d is the diameter of the orifice.

18 Claims, 6 Drawing Sheets

VORTEX RING MIXERS

REFERENCE TO RELATED APPLICATIONS

This is a continuation-in part of application Ser. No. 07/369,802 filed June 22, 1989, which in turn is a continuation-in part of application Ser. No. 07/169,966 filed Mar. 18, 1988, now abandoned, which in turn is a continuation in-part of application Ser. No. 07/028,508, filed Mar. 20, 1987, now abandoned.

BACKGROUND OF THE INVENTION

This invention relates to equipment for the mixing of fluids. The invention is particularly useful in, for example, mixing of stratified fluids and keeping in uniform suspension solid-fluid suspensions or solid-liquid slurries.

In the prior art, numerous devices using the oscillating motion of a perforated plate or a diaphragm or a piston have been used to either mix fluids or to pump a fluid in a specific direction. Furthermore, an extremely large number of rotating or oscillating blade systems have been developed for mixing purposes. Also, devices employing ultrasonic or high frequency oscillations have been used to create localized mixing. A problem with most of these devices, however, is that they dissipate a large part of the input energy in heat created from localized turbulence.

In contrast, the present invention is relatively much more energy efficient while moving and mixing relatively large volumes of fluid, and is relatively insensitive to the fluid viscosity compared with most other devices.

SUMMARY OF THE INVENTION

The present invention generates a ring vortex, similar to that which occurs in a mushroom cloud associated with an atomic explosion. The propagation of the ring vortex results in efficient mixing with low energy losses.

In accordance with one aspect of the invention, there is provided a vortex ring mixer for mixing fluids, the mixer comprising an orifice plate adapted to be located in a fluid to be mixed, the orifice plate having an orifice of diameter d formed therein. Means is provided for forcing fluid through the orifice in a direction perpendicular to the orifice plate, the fluid travelling a distance L relative to the orifice. The ratio of L/d is between 0.8 and 3.8.

According to another embodiment of the invention, there is provided a method of mixing a fluid. The method comprises the steps of introducing an orifice plate into the fluid, the orifice plate having an orifice of diameter d. Fluid is forced to travel a distance L through the orifice in a direction perpendicular to the orifice plate. The ratio of L/d is between 0.8 and 3.8.

BRIEF DESCRIPTION OF THE DRAWINGS

Preferred embodiments of the invention will now be described, with reference to the accompanying drawings, in which.

DETAILED DESCRIPTION OF THE PREFERRED EMBODIMENTS

Figure 1:
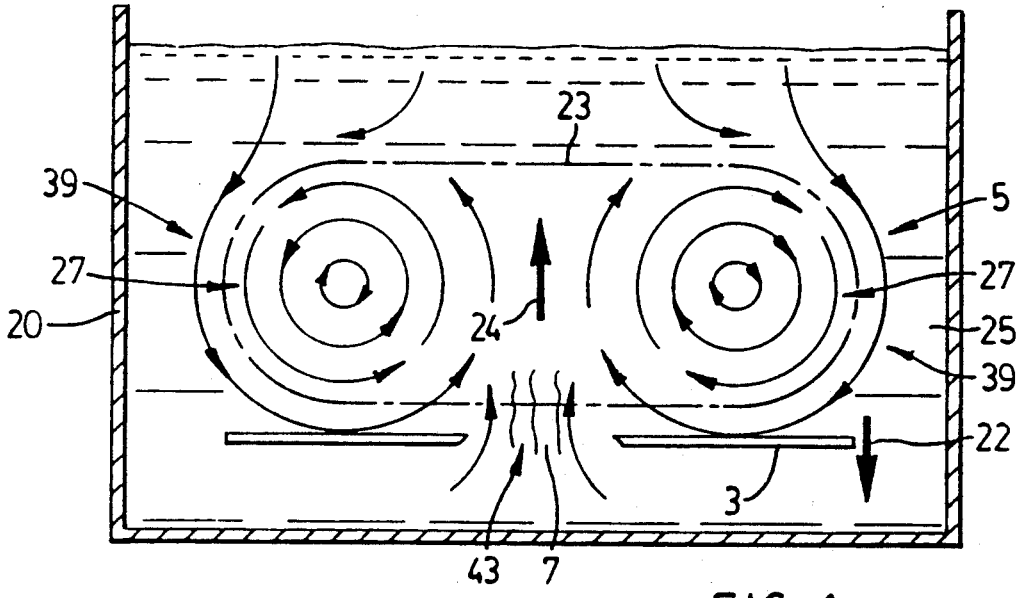
FIG. 1 is a diagrammatic view showing the operation of a vortex ring generator according to the present invention.

Referring first to FIG. 1, the operation of a vortex ring mixer or generator according to the present invention will be described briefly. An orifice plate 3 is shown, having an opening or orifice 7. The orifice plate 3 is disposed in a fluid 25 to be mixed, which in turn is contained in a container 20. A ring vortex or vortex ring, which is generally indicated by reference numeral 5, is formed in the fluid 25, by moving orifice plate 3 downwardly in the direction of arrow 22. This causes a slug of fluid to be forced upwardly through orifice 7 producing ring vortex 5.

Ring vortex 5, which is in the form of an oblate spheriod as indicated by the chain dotted line 23, moves upwardly in the direction of arrow 24. Ring vortex 5 in effect rolls through fluid 25, because the layer of fluid at the outer surface or boundary 27 of the vortex ring travels with or at the same speed as the adjacent fluid 39, the latter moving downwardly to be taken up or inducted into the centre of ring vortex 5. In fact, there is almost no viscous drag at the outer boundary 27 of the vortex ring 5, with the result that ring vortex 5 can travel or propagate great distances through fluid 25, even in very viscous or even non-Newtonian fluids. While some fluid is being inducted into ring vortex 5, there is also some fluid ejected from the ring vortex in the form of a fluid trail or wake 43. This induction, wake, and the general flow or circulation pattern around the ring vortex as it moves upwardly creates very efficient mixing or agitation of fluid 25. In order to produce the type of ring vortex 5 in question, however, there is a definite relationship between the diameter of orifice and the travel of orifice plate 3, as will be described further below.

Figure 2:
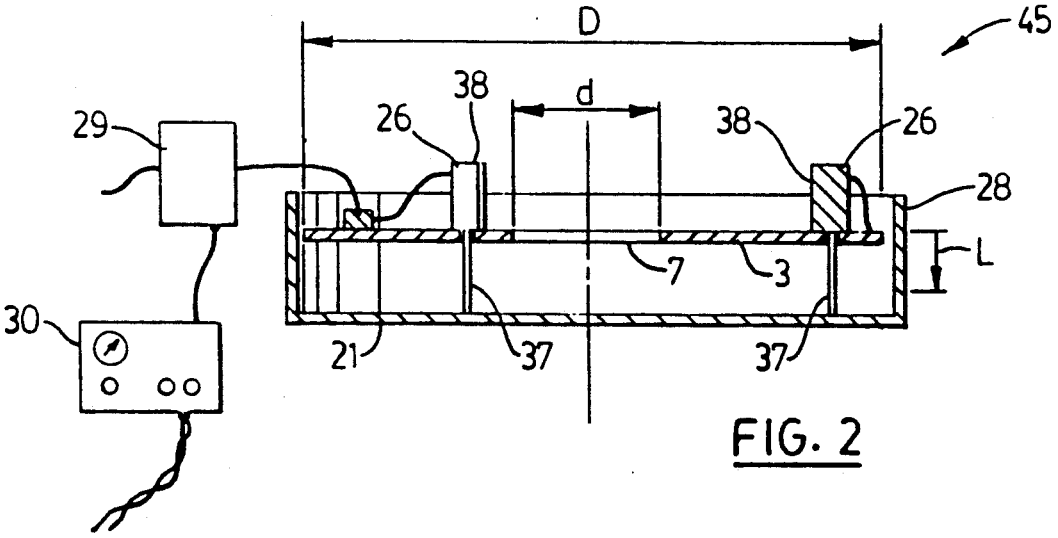
FIG. 2 is a sectional view taken along lines 2—2 of FIG. 3 showing a preferred embodiment of a vortex ring generator according to the present invention.
Figure 3:
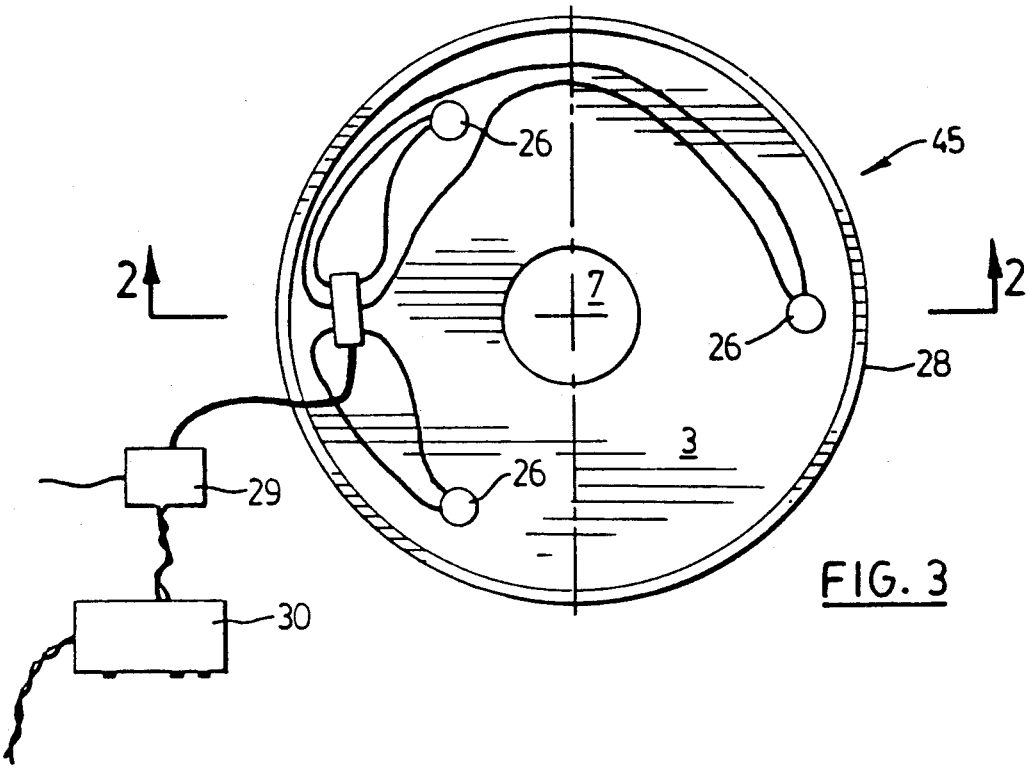
FIG. 3 is a plan view of the vortex ring generator shown in FIG. 2.

Referring next to FIGS. 2 and 3 a portable ring vortex generator is generally indicated by reference number 45. Generator 45 has three hydraulic or pneumatic actuators 26 which operate a moving orifice plate 3 with centrally located orifice 7. The orifice plate 3 is located in a cylindrical housing 28, open at one end and having a closed end or base plate or end wall 21, the housing acting as an anchor for the moving orifice plate. Piston rods 37 of actuators 26 are connected to the base plate 21 of housing 28, and cylinders 38 of actuators 26 are attached to orifice plate 3. Orifice plate 3 moves up and down inside housing 28 in a controlled motion and generates ring vortices 5 as seen in FIG. 1.

The orifice plate 3 is moved by actuators 26 in a controlled manner to achieve the most efficient results for various liquids and suspensions. This control is achieved by the combination of a hydraulic or air valve 29 and electric control circuit 30. Generator 45 is portable and can be large or quite small. The outer diameter of orifice plate 3 compared with the orifice diameter d is such that the distance from the centre of orifice 7 to the vertical wall of housing 28 or any other adjacent vertical wall (or the peripheral edge of orifice plate 3) should be equal to or greater than twice the diameter of orifice 7. Distances less than this will cause the ring vortex to collide with the adjacent vertical wall.

Figure 4:
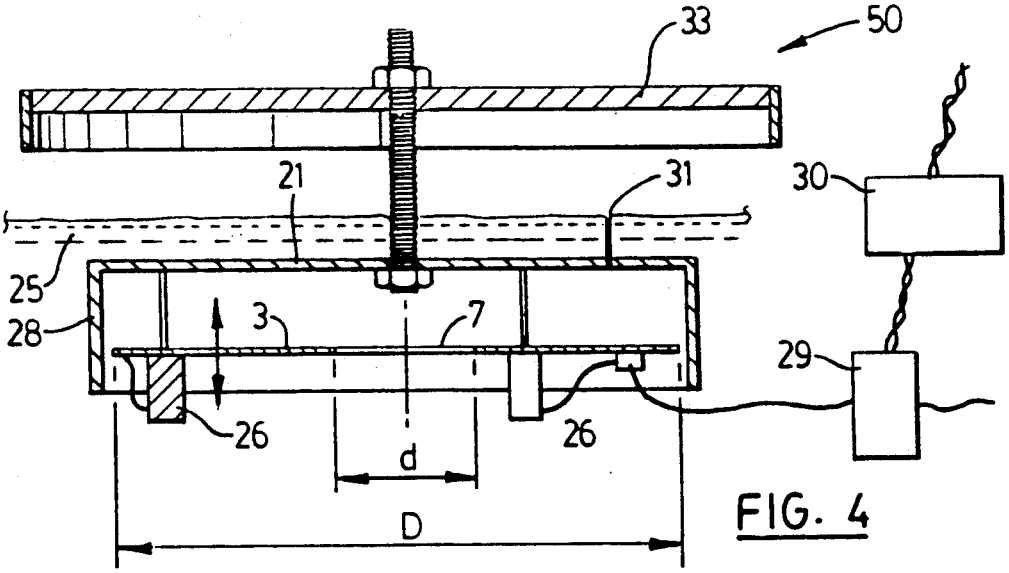
FIG. 4 is a sectional view of a vortex ring generator similar to that of FIGS. 2 and 3, but showing the generator mounted in an inverted position.

FIG. 4 shows a ring vortex generator 50 which is mounted upside down on an adjustable support bar 33 so that the ring vortices are projected downwardly. Generator 50 is kept at or near the liquid surface, but it could be located at any required depth in the liquid being mixed or agitated. Furthermore, by the introduction of a small controlled air vent 31, air (or any other gas) may be admitted to generator 50 and a highly aerated vortex ring is emitted from the unit and projected downwardly into fluid 25. This operation has been tested and found to result in very efficient aeration of a fluid and therefore the unit can be used as a very efficient aeration unit, and could be used for the aeration and destratification of lakes or large bodies of liquids. If gases other than air are used, for example to produce chemical reactions while mixing, this is still considered to come within the term "aeration" for the purposes of this disclosure.

Figure 5:
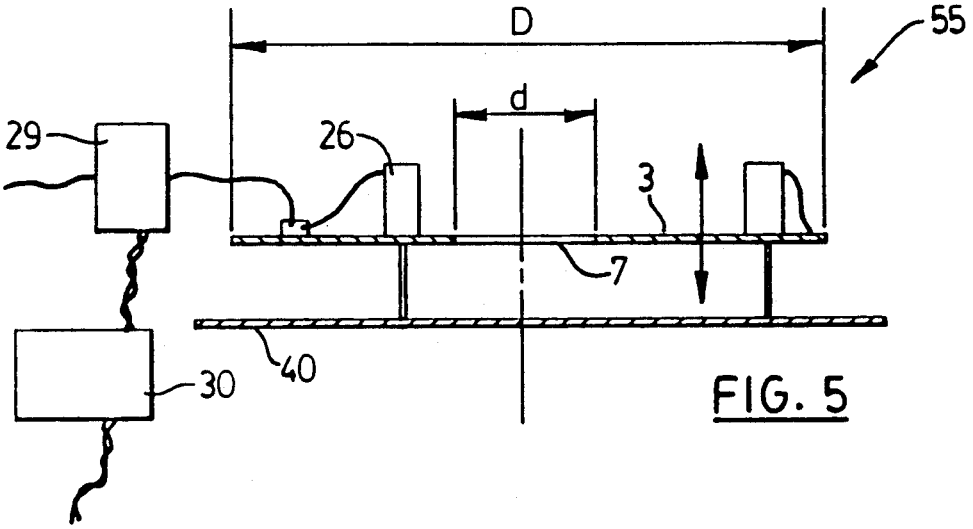
FIG. 5 is a sectional view of another embodiment of a vortex ring generator according to the present invention.

FIG. 5 shows another embodiment of a ring vortex generator 55 in which the cylindrical wall of housing 28 is removed leaving a base plate 40. This results in radial discharge of the liquid as well as the projection of a vortex ring and also gives excellent mixing performance. The diameter of base plate 40 is larger than that for a generator having side walls.

As a further embodiment, rather than removing the cylindrical wall of housing 28 as in FIG. 5, a flexible or resilient cylindrical member or membrane could be used joining the adjacent peripheral edges of orifice plate 3 and base plate 40.

Figure 6:
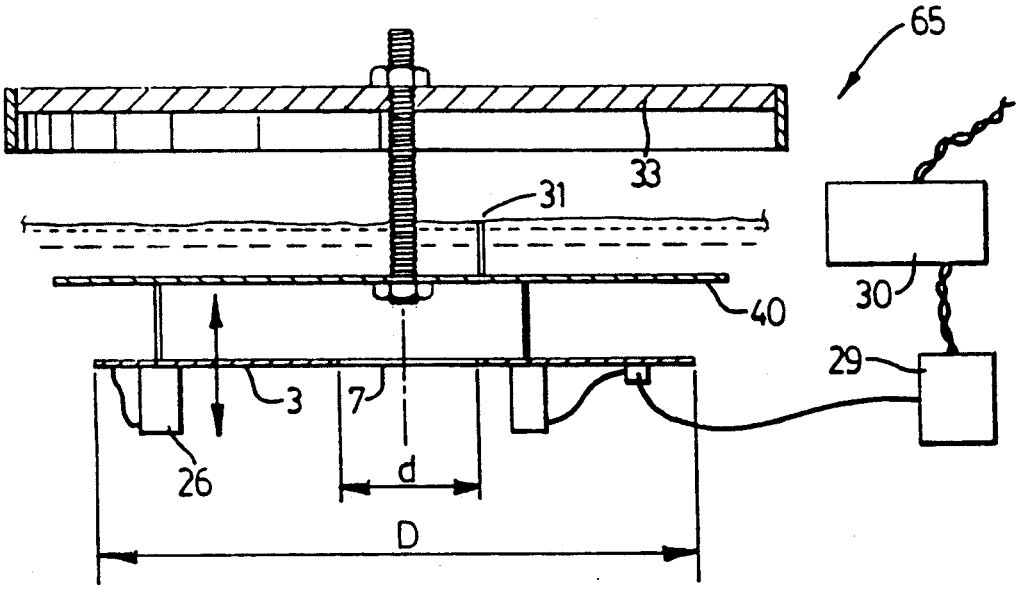
FIG. 6 is a sectional view of the vortex ring generator of FIG. 5, but mounted in an inverted position.

FIG. 6 shows a ring vortex generator 65 which is similar to generator 55, but which is inverted and supported on an adjustable support bar 33 like generator 50 of FIG. 4.

Figure 7:
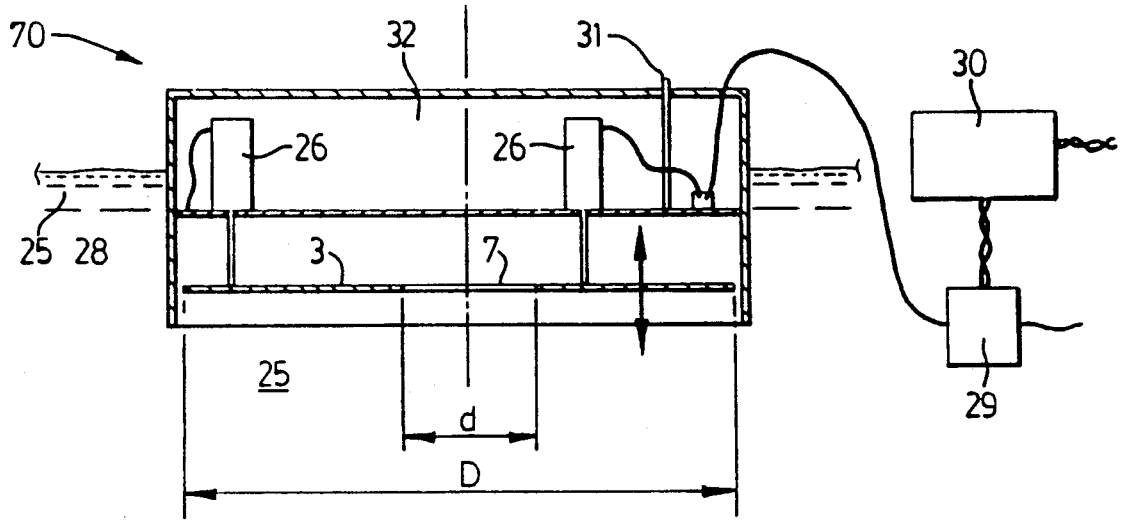
FIG. 7 is a sectional view of a floating embodiment of a vortex ring generator which is similar to the embodiment of FIG. 4.

FIG. 7 shows a ring vortex generator 70 which is basically the same as generator 50, but with a flotation tank 32 enclosing actuators 26 therein so that generator 50 floats on the surface of fluid 25.

Figure 8:
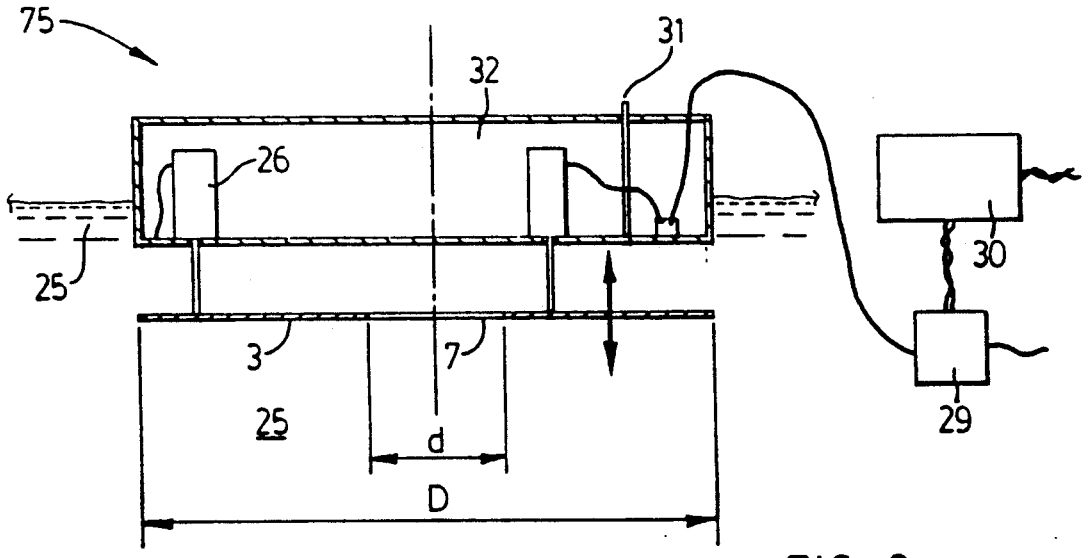
FIG. 8 is a sectional view of a floating embodiment of a vortex ring generator which is similar to the embodiment of FIG. 6.

FIG. 8 shows a ring vortex generator 75 which is basically the same as generator 65, but again with a flotation tank 32 enclosing actuators 26, so that generator 75 also floats on the surface of fluid 25.

If it is required that the ring vortices travel large distances, then the sidewall configurations as in FIGS. 2, 4 and 7 are used to induce a high energy to the vortex ring. However, if there is need for considerable agitation in the vicinity of the orifice plate 3, then the side wall is removed as in FIGS. 5, 6 and 8 to permit some radial flow of the fluid.

Figure 9:
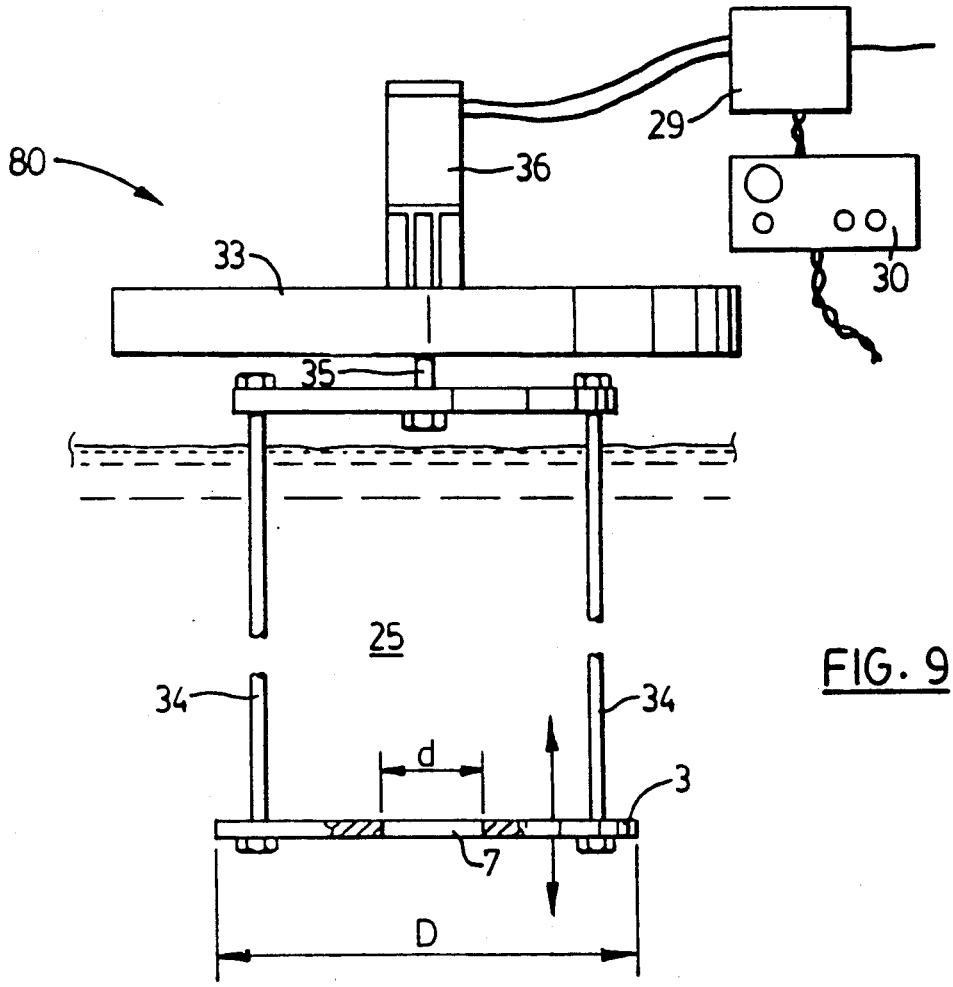
FIG. 9 is an elevational view of yet another embodiment of a vortex ring generator according to the present invention.
Figure 10:
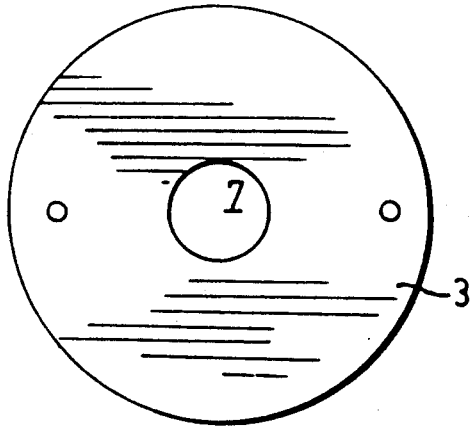
FIG. 10 is a bottom view of the orifice plate of the embodiment shown in FIG. 9.

Another vortex ring generator 80 is shown in FIGS. 9 and 10 and has a vortex generating orifice plate 3 which is activated by two rods 34, which are in turn actuated by a single rod 35 from a pneumatic actuator 36 mounted on support bar 33. Actuator 36 has an associated air valve 29 and control circuit 30 mounted in any suitable manner. If generator 80 is to be used for an explosive or flammable liquid and an electrical control system is used, the electrical controller can be located in a separate control box located remote from the mixer. However, a totally pneumatic control system is normally employed for flammable or explosive fluids. In generator 80, both the pressure and therefore the force of the agitation and also the frequency of the agitative cycle can be varied. Generator 80 can be used in a similar manner to conventional mixers, that is with the primary energizing unit located outside the mixing vessel as compared with the immersed units described above.

Figure 11:
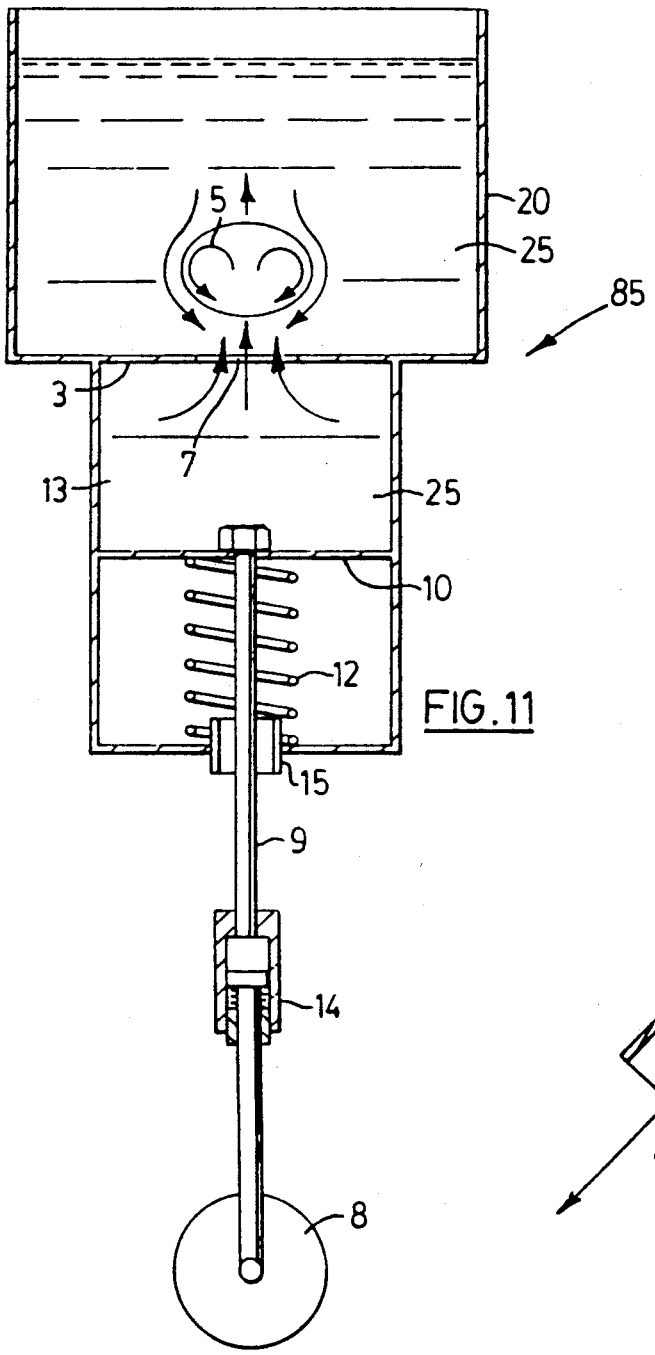
FIG. 11 is a sectional view of yet another embodiment of a vortex ring generator according to the present invention.

Yet another embodiment of a ring vortex generator 85 is shown in FIG. 11. A prime mover 8 reciprocates a rod 9, which in turn operates a driver 10, in the form of a diaphragm or a piston located in a primary fluid chamber 13 located adjacent to orifice 7. When driver 10 is pulled away from the orifice 7, a return spring 12 is compressed. Rod 9 is then instantly released causing the spring 12 rapidly to force the driver 10 upwardly to force the fluid in the primary chamber 13 through the orifice 7 and create ring vortex 5. In this case, the bottom wall of container or tank 20 forms the orifice plate 3. The velocity and stroke of driver 10 indicates the velocity of propagation and volume of the ring vortex 5 in much the same manner as in the previously described embodiments.

The stroke of rod 9 and therefore the volume of fluid discharged during each stroke is controlled using an adjuster 14. A spring pre-tensioning nut 15 is used to balance the forces on driver 10 especially where generator 85 is used with a pressurized tank or is located at the bottom of a tank filled with a relatively dense fluid or large quantity of fluid.

Various configurations and geometries can be used for orifice 7 in all of the embodiments described above, but the optimal shape is circular.

Figure 12:
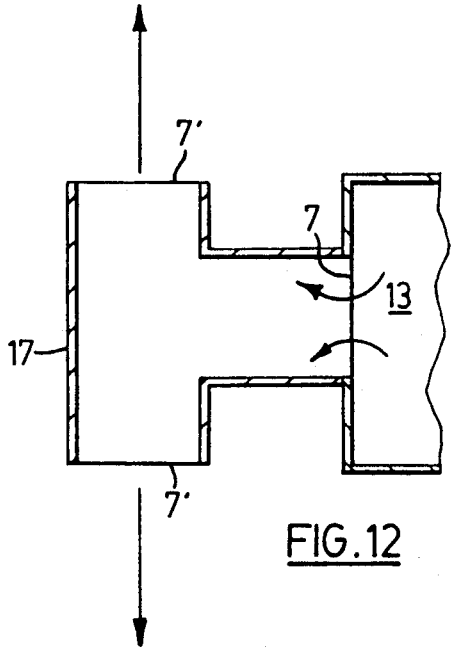
FIG. 12 is a sectional view of a "T" adaptor for a vortex ring generator according to the present invention.
Figure 13:
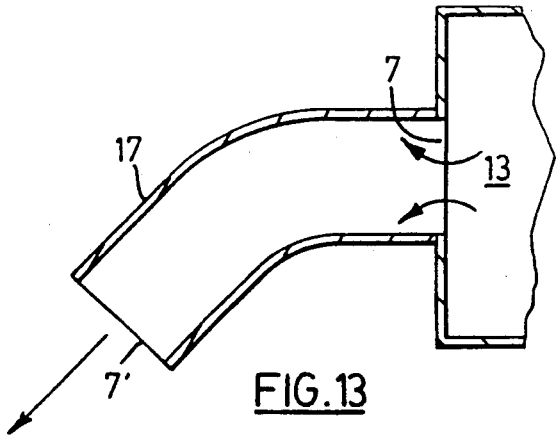
FIG. 13 is a sectional view of an angled adaptor for a vortex ring generator according to the present invention.

Optionally, extension tube or tubular adapters 17 can be used, as shown in FIGS. 12 and 13. Adapters 17 act as orifice extensions and can be employed with any of the embodiments described above. Adapters 17 are used to control the direction of propagation of the vortex ring. They may also be used to give considerable flexibility in the use and location of the ring vortex generator in a particular fluid field, such as the location of a device in the side wall, bottom or top of a mixing tank.

In some cases, it may be desirable to use two or more orifices, in orifice plate 3. In this case, the orifices must be spaced apart or the respective vortices generated can collide with each other before they have travelled any appreciable distance. A semi-empirical analysis found that the minimum reasonable distance between the centres of adjacent orifices to be given by:

$$X/d \geqq 2.5$$

where X is the centre to centre distance between the orifices and d is the orifice diameter. In other words, the distance from the center of one orifice to the peripheral edge of an adjacent orifice (or the peripheral edge of orifice plate 3 which is equivalent for the purposes of this disclosure) should be greater than twice the diameter of the first orifice.

As mentioned above, there is a required relationship between the diameter d of orifice 7 and the stroke L (see FIG. 2) of orifice plate 3 in order to produce the ring vortices according to the present invention. This relationship refers to the ratio of the equivalent plug length to the diameter of the orifice and may be expressed as follows:

$$0.8 \leqq L/d \leqq 3.8$$

where d is the orifice diameter and L is the equivalent plug length which is the distance travelled by orifice plate 3 or the length of the fluid plug passing through orifice 7 (such as in the FIG. 11 embodiment) in generating ring vortex 5.

A ratio of $1.5 \leqq L/d \leqq 3.5$ is particularly useful.

The optimal value based on experimental data appears to be given by:

$$L/d_m \simeq 2.8$$

At the instant and immediately after the generation of a ring vortex, the ratio of the translational velocity of the vortex ring $U_r$ to the mean velocity of the slug of fluid passing through the orifice $U_m$ is given by:

$$U_r/U_m \simeq 0.6$$

For relatively small distances, $U_m$ can be considered to be constant, and therefore the time t for a vortex ring to reach the surface or travel a distance H is:

$$t = H/L_r$$

To mix a fluid in a container 20, repeated strokes of orifice plate 3 may be used to produce repeated or successive ring vortices 5. The frequency required to mix or maintain a mixed condition obviously depends on the type of material(s) being mixed. However, in a simple two fluid system in which the density difference is relatively small (that is, a density ratio of less than 1.1), it has been found that a frequency of 0.25 Hz was quite adequate. However for slurries such as lime, in which the density ratio between the particles and the fluid can be as high as 3.0, a higher frequency should be used. It was found that a frequency of about 0.4 Hz was adequate for a lime slurry with a weight concentration of 24% and a density ratio of 2.29.

Frequencies of greater than about 0.6 Hz may result in the ingestion of secondary vortices into the orifice and excessive localized turbulence which results in the generation of a weak primary vortex ring. This to a large extent can be controlled by the use of a stroke characteristic such that there is a relatively fast vortex generation stroke of orifice plate 3 or driver 10 followed by a slow return stroke, or by introducing a dwell period after the return stroke. For these reasons, a sinusoidal motion of orifice plate 3 or driver 10 has been found not to be desirable for the efficient generation of vortices. It also causes excessive generation of localized turbulence which can affect the efficient generation of vortex rings.

The preferred stroke frequency of orifice plate 3 is between 0.25 Hz and 0.6 Hz.

It is difficult to predict the distance that a vortex will travel before it disintegrates, and it depends on a number of factors, such as whether it is initially stable or unstable, laminar or turbulent. It also depends on the initial velocity of the vortex $U_r$, and any density differences or density stratification in the fluid initially in the ring at its formative stages and the ambient or bulk of the fluid to be mixed, but it is relatively insensitive to the fluid's viscosity or whether the fluid is Newtonian or non-Newtonian, since the shear and drag forces are relatively insignificant in the motion of a vortex ring. However, vertical distances of 2 m in a 51% by weight aqueous lime suspension were achieved with the ring still very energetic when it broke the liquid surface, and in water solutions vortices travelled vertically 1.3 m and then continued to travel in the air over 1 m after leaving the surface of the water. On the basis of qualitative observations it is felt that distances of over 10 m or 100×diameter of the orifice would not be unreasonable when the density difference is not too great, such as ≃1.1. Smaller d/D ratios (see FIG. 2) tend to produce vortex rings that travel longer distances.

In the embodiments described above, a planar orifice plate 3 has been described. However, it will be appreciated that the orifice plate could be concave or convex, or even in the form of a tube with alternate means, such as shown in FIG. 11, to force the fluid through the orifice. In such cases suitable adjustments would be made to the formulae discussed above to describe the motion and generation of the vortex rings. For the purposes of this disclosure, the term planar orifice plate is intended to include all of these variations.

It will be appreciated that the above description relates to the preferred and alternative embodiments by way of example only. Many variations on the invention will be obvious to those skilled in the art, and such obvious variations are within the scope of the invention as described and claimed, whether or not expressly described.

What is claimed is:

1. A vortex ring mixer for mixing fluids, the mixer comprising:

an orifice plate adapted to be located in a fluid to be mixed, the orifice plate having an orifice of diameter d formed therein;

means for forcing said fluid to be mixed through said orifice in a direction perpendicular to the orifice plate, said fluid forced through said orifice travelling a distance L relative to said orifice; wherein the ratio of L/d is between 0.8 and 3.8.

2. A mixer as claimed in claim 1 and further comprising a base plate spaced from the orifice plate, the means for forcing fluid through the orifice including means for producing relative movement between the orifice and base plates.

3. A mixer as claimed in claim 2 and further comprising a cylindrical housing open at one end thereof, the orifice plate being located in the housing parallel to said open end.

4. A mixer as claimed in claim 3 wherein the cylindrical housing has a closed end wall located parallel to the orifice plate, said end wall forming said base plate.

5. A mixer as claimed in claim 4 and further comprising means for injecting a gas into said housing for producing an aerated vortex ring.

6. A mixer as claimed in claim 2 and further comprising flotation means attached to the base plate for floating the base plate at the surface of the fluid with the orifice plate located in the fluid below the base plate.

7. A mixer as claimed in claim 2 wherein said means for producing relative movement between the orifice and base plates includes means for causing reciprocal movement therebetween, said reciprocal movement having a fast vortex ring generating stroke and a slow return stroke.

8. A mixer as claimed in claim 2 wherein said means for producing relative movement between the orifice and base plates includes means for causing reciprocal movement therebetween, said reciprocal movement having a fast vortex ring generating stroke and a slow return stroke the frequency of said reciprocal movement being between 0.25 and 3 Hz.

9. A mixer as claimed in claim 1 wherein the means for forcing fluid through the orifice plate includes an actuator operatively connected to the orifice plate to move the plate said distance L.

10. A mixer as claimed in claim 9 and further comprising means for mounting said actuator outside the fluid, and means for connecting the actuator to the orifice plate.

11. A mixer as claimed in claim 1 wherein the ratio of L/d is between 1.5 and 3.5.

12. A mixer as claimed in claim 1, wherein the L/d ratio is generally equal to 2.8.

13. A mixer as claimed in claim 1 wherein said orifice plate has a peripheral edge, and wherein the distance from the centre of said orifice to said peripheral edge is at least twice the diameter d of said orifice.

14. A mixer as claimed in claim 1 and further comprising a tubular adaptor connected to the orifice plate in communication with the orifice plate for controlling the direction of propagation of the ring vortex.

15. A method of mixing a fluid comprising:

introducing an orifice plate into the fluid, said orifice plate having an orifice of diameter d;

forcing fluid to travel a distance L through said orifice in a direction perpendicular to the orifice plate;

wherein the ratio of L/d is between 0.8 and 3.8.

16. A method of mixing a fluid as claimed in claim 15 wherein the fluid is forced through said orifice by moving the orifice plate said distance L in a direction perpendicular to said orifice.

17. A method of mixing a fluid as claimed in claim 15 wherein fluid is forced through said orifice repeatedly, the frequency of repetition being between 0.25 and 0.6 Hz.

18. A method of mixing a fluid as claimed in claim 15 and further comprising the step of injecting a gas into the fluid before it is forced through said orifice to produce an aerated vortex ring.

* * * * *